US012710232B2

(12) United States Patent
Kubasik et al.

(10) Patent No.: US 12,710,232 B2
(45) Date of Patent: Aug. 18, 2026

(54) CONDENSER

(71) Applicant: BDR THERMEA GROUP B.V., Apeldoorn (NL)

(72) Inventors: Sébastien Kubasik, Apeldoorn (NL); Benjamin Chassagnard, Apeldoorn (NL)

( * ) Notice: Subject to any disclaimer, the term of this patent is extended or adjusted under 35 U.S.C. 154(b) by 141 days.

(21) Appl. No.: 18/554,343

(22) PCT Filed: Apr. 6, 2022

(86) PCT No.: PCT/EP2022/059089
§ 371 (c)(1),
(2) Date: Oct. 6, 2023

(87) PCT Pub. No.: WO2022/214534
PCT Pub. Date: Oct. 13, 2022

(65) Prior Publication Data

US 2024/0219122 A1 Jul. 4, 2024

(30) Foreign Application Priority Data

Apr. 8, 2021 (EP) ..... 21167311

(51) Int. Cl.
*F28F 1/14* (2006.01)
*F25B 39/04* (2006.01)
(Continued)

(52) U.S. Cl.
CPC ..... *F28D 1/06* (2013.01); *F25B 39/04* (2013.01); *F28F 3/14* (2013.01); *F28D 2021/007* (2013.01); *F28F 2210/02* (2013.01)

(58) Field of Classification Search
CPC .... F28D 1/06; F24H 4/04; F25B 39/04; F25B 2339/043
See application file for complete search history.

(56) References Cited

U.S. PATENT DOCUMENTS 2,716,866 A * 9/1955 Silva ..... F24H 4/04 122/26
2002/0083734 A1* 7/2002 Cho ..... F28B 1/06 62/509

FOREIGN PATENT DOCUMENTS

FR 2549585 A1 1/1985
FR 2963416 A1 * 2/2012 ..... F28D 7/08
(Continued)

OTHER PUBLICATIONS

Search Report and Written Opinion of the International Searching Authority (ISA) for PCT Application PCT/EP2022/059089, provided by the European Patent Office on Jul. 22, 2022.

*Primary Examiner* — Eric S Ruppert

(57) ABSTRACT

The invention relates to a condenser comprising a housing having an inlet opening for inputting fluid into the condenser and an outlet opening for outputting the fluid out of the condenser and a channel system for fluidically connecting the inlet opening and the outlet opening, wherein the channel system is arranged within the housing and comprises a splitting portion in which the inputted fluid is split to a plurality of channels and a grouping portion in which the plurality of channels is united to an outlet channel, wherein a first end of the outlet channel ends in the outlet opening and a second end of the outlet channel ends in the grouping portion. The condenser is characterized in that a distance between the second end of the outlet channel and a housing bottom in a vertical direction is between 0% to 80% of a distance between the housing bottom and an upper housing side in a vertical direction.

20 Claims, 7 Drawing Sheets

Figure 1:
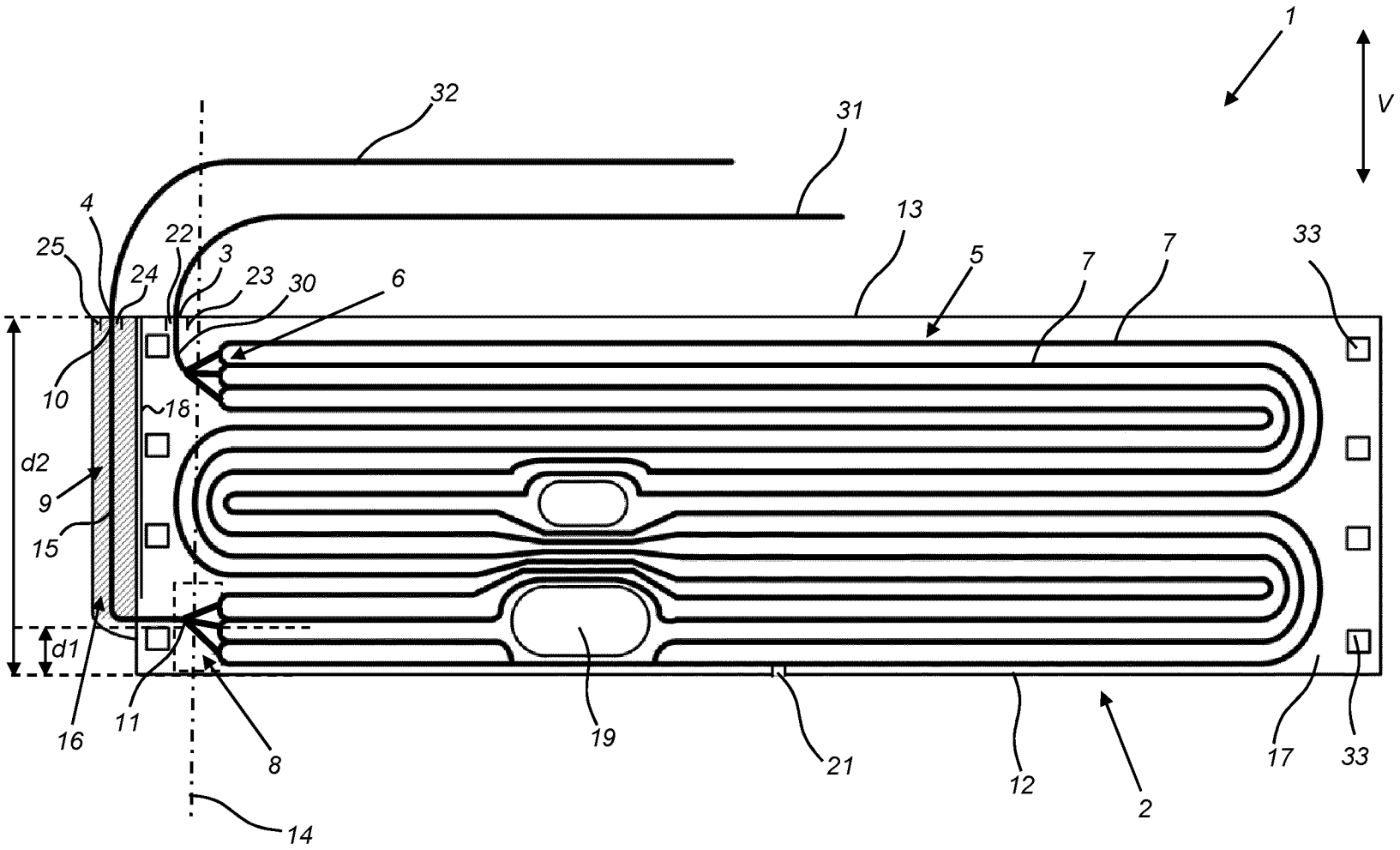

(51) Int. Cl.

| | |
|---|---|
| ***F28D 1/06*** | (2006.01) |
| ***F28F 3/14*** | (2006.01) |
| *F28D 21/00* | (2006.01) |

(56) References Cited

FOREIGN PATENT DOCUMENTS

| | | | | | |
|---|---|---|---|---|---|
| GB | 2497171 | A | 6/2013 | | |
| WO | WO-2017012718 | A1 * | 1/2017 | ..... | F25B 30/02 |
| WO | WO-2022114683 | A1 * | 6/2022 | ..... | F25B 41/42 |

* cited by examiner

CONDENSER

The invention relates to a condenser, a heat transfer system comprising such a condenser. Additionally, the invention relates to a heat pump with such a condenser or heat transfer system and to the use of the condenser in the heat transfer system or the heat pump.

A plurality of different shaped condensers is known from the prior art. The condenser can be used in heat pumps. In order to fulfil regulations. it is necessary to use natural refrigerants. In particular, the usage of refrigerants as R134a that are harmful to environment shall be prevented. Due to said purpose it is known to use refrigerants that are a flammable fluid like propane. In said case the risk of leakage is crucial and more impacting because the load is 10 time lower in comparison to condensers in which R134a is used as refrigerant. It is known that the sustainability against leakage is influenced by the subcooling of the fluid in the condenser. Thus, high efforts are made in improving the efficiency of the condenser.

WO 2017 012 718 A1 discloses a condenser in which natural refrigerant flows. The condenser has a housing and channel system arranged in the housing. The condenser is in contact with a fluid tank. The channel system comprises a single channel being followed by a distribution area including a plurality of dividing bifurcations, each distributing the carried fluid from a channel having a current cross-section into two channels having the same cross-section and an outlet for the refrigerant fluid, in liquid phase, along a single channel. The outlet is preceded by at least one grouping area including a plurality of concentrating bifurcations, said grouping area grouping N channels having the same cross-section into channels having the same cross-section.

A disadvantage of the condenser is that subcooled fluid is heated up by the fluid arranged in the fluid tank during its flow between the grouping area and an outlet opening of the condenser. The heat area in which the fluid is heated is large so that the heat transfer from the fluid tank to the fluid is high. The heat transfer from the fluid tank to the fluid flowing in the condenser results from that in the fluid tank warmer fluid is arranged in an upper are of the fluid tank due to density differences. However, as mentioned above the heating of the fluid has disadvantages with respect to the leakage when the condenser is used e.g. in a heat pump.

The object of the invention is to provide a condenser in which the fluid flowing out of the condenser is less heated than in the known condenser.

The object is solved by a condenser comprising a housing having an inlet opening for inputting fluid into the condenser and an outlet opening for outputting the fluid out of the condenser and a channel system for fluidically connecting the inlet opening and the outlet opening, wherein the channel system is arranged within the housing and comprises a splitting portion in which the inputted fluid is split to a plurality of channels and a grouping portion in which the plurality of channels is united to an outlet channel, wherein a first end of the outlet channel ends in the outlet opening and a second end of the outlet channel ends in the grouping portion, characterized in that a distance between the second end of the outlet channel and a housing bottom in a vertical direction is between 0% to 80% of a distance between the housing bottom and an upper housing side in the vertical direction.

It was recognized that the fluid can be prevented from heating up as much as in the known condenser by providing the second end of the outlet channel at a position that is located nearer to the housing bottom in comparison to the known condenser. Such an arrangement of the second end of the outlet channel enables that fluid flowing in the outlet channel is not heated up as much as in the condensers disclosed in WO 2017 012 718 A1 as the heat area in which the fluid can be heated up by e.g. a fluid tank is lower than in the condenser disclosed in WO 2017 012 718 A1. In particular, in the condenser it is possible that the fluid flown into the condenser is, in particular, continuously, cooled down between the inlet opening and the grouping portion. After passing the grouping portion the fluid cooled is slightly heated until it leaves the condenser by means of the outlet opening. In contrary to that in the condenser disclosed in WO 2017 012 718 A1 the fluid is firstly cooled. However, the fluid is also heated before it reaches the outlet channel.

This improvement will help to gain in total efficiency by increasing an expansion valve capacity and avoid that gas is created in the outlet channel. Additionally, subcooling of the fluid can be improved leading to a low leakage risk when the condenser is used e.g. in a heat pump.

The condenser has also a small channel volume in order to reduce the refrigerant load. For example, the condenser can have a volume of 0.15l (liter) in comparison to known condensers having a volume of 3l.

A fluid connection can be a connection enabling that a fluid flows from one component to another component or vice versa. For example, channels provided in the housing can be considered as fluid connections as they enable a fluid flow from the inlet opening to the outlet opening.

The inlet opening can be fluidically connected with an inlet line and the outlet opening can be fluidically connected with an outlet line. The inlet line and the outlet line can be fixedly attached to the condenser, respectively. In particular, the inlet line and the outlet line can be welded to the condenser, in particular, the housing.

The fluid flowing in the inlet line and via the inlet opening into the condenser is usually at least partly in a gaseous phase. The fluid flowing out of the condenser via the outlet opening into the outlet line is in a liquid phase. Thus, a phase change occurs within the channel system. In particular, the phase change occurs prior to the liquid flowing into the outlet channel of the channel system.

As "housing bottom" the housing side of the condenser is considered that in an attached state of the condenser to a fluid tank is arranged geodetically lowest point of the housing, with reference to the ground. As "upper housing side" the housing side of the condenser is considered that is arranged geodetically highest point, which is thus positioned furthest from the ground. The housing bottom and the upper housing side can extend parallel to each other and/or are arranged opposite to each other. In an attached state the housing bottom and the upper housing side are spaced from each other along the vertical direction. The vertical direction is parallel to a gravity direction.

The distance can be determined in a plane that is orientated parallel to the vertical direction and comprises the second end of the outlet channel and the housing bottom and/or the upper housing side. The plane intersects the housing bottom and/or the upper housing side and, thus, does not comprise the complete surface of the housing bottom and/or the complete surface of the upper housing side.

The channels extending between the splitting portion and the grouping portion can have the same cross section. The cross section can be constant along the channel's extension between the splitting portion and the grouping portion. The outlet channel can have the same cross section as the channels. The cross section of the outlet channel can be constant between the first and second end of the outlet channel.

The fluid flowing in the condenser can be a natural refrigerant, such as ammonia (NH3), carbon dioxide (CO2) and hydrocarbons, in particular propane or isobutane. Further suitable refrigerants comprise A2L, R32, R1234YF, R134a or R410. The use of refrigerants R134a and R410 has the advantage that the load and/or costs can be reduced.

If the distance between the second end of the outlet channel and the housing bottom is 0% of the distance between the housing bottom and the upper housing side, the outlet opening is directly fluidically connected with the grouping channel. In said case the outlet channel corresponds to the outlet opening.

According to an embodiment a distance between the second end of the outlet channel and a housing bottom can be smaller in the vertical direction than a distance between the second end of the outlet channel and the upper housing side in the vertical direction. The distance between the second end of the outlet channel and the housing bottom can be between 0% to 40%, in particular 10% to 30%, preferably 15% to 25% of the distance between the housing bottom and the upper housing side. Such an embodiment has the advantage that the heat amount from the fluid tank provided to the fluid is further reduced.

Water can be stored in the fluid tank. The water is colder than the fluid flowing into the condenser resulting in that the fluid flowing into the condenser is cooled by the water provided in the tank. However, as discussed above due to the density differences water arranged in an upper region of the water tank is warmer than water arranged in a lower region of the water tank. This leads to that the fluid flowing in at least a part of the outlet channel can be heated up by the water arranged in the water tank.

The grouping portion can be adapted such that the plurality of channels is united to merely one outlet channel. In said case the condenser only comprises merely one outlet opening and the heat amount provided to the fluid by the fluid tank is further reduced. The grouping portion can comprise a curved, in particular circular shaped, channel. The plurality of channels and the outlet channel can be in direct fluid communication with said channel. The splitting portion and the grouping portion can have the same or similar basic shape.

The length of the outlet channel can be smaller than the length of one channel, in particular the length of each channel of the plurality of channels, between the splitting portion to the grouping portion. The shorter the length of the outlet channel the less the fluid in the outlet channel can be heated by the fluid of the fluid tank.

A short length of the outlet channel can be achieved when the outlet channel comprises or only has a straight portion between its first end and second end. The straight portion can extend in the vertical direction when the condenser is attached to the tank. In particular, the straight portion can be configured that a fluid flow direction is perpendicular to a fluid flow direction of the fluid flowing into the grouping portion. In particular, the straight portion of the outer channel can be longer than a remaining part of the outlet channel. The remaining part can fluidically connect the grouping portion of the channel system with the straight portion of the outlet channel. The provision of a straight portion has the advantage that the area for heat exchange between the fluid flowing in the outlet channel and the fluid tank is minimized. As discussed above, in the condenser is heated after it passes the grouping portion. As a straight portion is the shortest possibility to connect two points the heat area is minimized.

The outlet channel can be adapted such that the fluid is not redirected between the second end of the outlet channel and the first end of the outlet channel. This can be realized if the outlet channel comprises merely a straight portion. Then the straight portion can extend in a direction, in particular a horizontal direction, that can be parallel to the upper housing side.

Alternatively, the fluid flowing in the outlet channel can be redirected merely once between the second end of the outlet channel and the first end of the outlet channel. This can be necessary if the outlet opening is arranged at the upper housing side.

According to an embodiment the outlet opening and the inlet opening can be arranged at the upper housing side. Alternatively, the outlet opening and the inlet opening are arranged on different housing sides. In particular, the inlet opening can be arranged at the upper housing side and the outlet opening can be arranged at a lateral housing side. The lateral housing side connects the upper housing side with the housing bottom. Alternatively, the outlet opening is arranged at the housing bottom. In said case the heat transfer from the fluid tank to the fluid flowing in the outlet channel is further reduced.

The housing can be adapted to be flexible so that it can be easily attached to the fluid tank. Additionally, the housing can be adapted such that a housing part comprising at least a part of the outlet channel protrudes from a remaining housing part. The housing part can comprise at least a part of the straight portion of the outlet channel. At least a part of the housing part and the remaining housing part can be arranged offset to each other. In particular, the housing part can protrude from the remaining housing part in a radial direction with respect to the fluid tank. The housing can comprise a slot dividing at least a part of the housing part from the remaining housing part. In particular, the slot can extend from the upper housing side towards the housing bottom. The provision of the slot simplifies to bend the housing part so that it protrudes form the remaining housing part. Additionally, the slot reduces the thermal conduction.

The housing can have a rectangular shape wherein the upper housing side and the housing bottom can form the longer sides of the rectangular. Alternatively, the housing can have other shapes. In particular, the housing can have a circular shape or a square shape. The shape form depends on the application of the condenser.

A distance between two channels of the plurality of channels in a direction along the short side of the housing is shorter than a distance between at least a part of the outlet channel and the channels of the plurality of channels in another direction along the length side of the housing. In particular, the distance between the straight portion of the outlet channel and a further plane comprising the maximum extension of a channel, in particular each of the channels, that is directed towards the straight portion can be shorter than the distance between the channels. Such an arrangement of the outlet channel secures that a distance area exists between the outlet channel and the channels so that the heat input form the fluid flowing in the channels to the fluid flowing in the outlet channel due to heat conduction is low.

According to an embodiment, at least one channel of the plurality of channels extending between the splitting portion and the grouping portion extends in a meandering pattern. In particular, all channels of the plurality of channels extends in the meandering pattern. Such a pattern increases the heat transfer area so that it is easily secured that the fluid flowing in the channels changes from the gas phase to the liquid phase.

The number of channels extending between the splitting portion and the grouping portion can be constant. That means, there is no other grouping portion by means of which the number of channels is reduced. The channel number can be kept constant because the respective channel volume can be nearly completely filled with fluid. In particular, 90% of the channel volume can be filled with fluid.

The housing can be a roll-bonded housing. Roll bonding is welding process in which two or more plates can be welded together through a set of rollers that produce extreme pressure. As result a bond occurs and new product is formed by the two plates. Such a roll bonded housing has the advantage that it is flexible and thus can be easily attached to a cylindrical fluid tank ensuring that the contact face between the housing and the fluid tank is large.

The housing can comprise two plates that are bonded, in particular roll bonded or brazed or welded, together. One of said plates can be embossed to form the channel system. The embossing can be carried out prior to assembling the plates. Alternatively, the embossing can be carried out after assembling the plates, for example by inflation. In this case, a diffusion barrier agent is applied to one of the plates in a pattern reproducing the channel system, so that the two plates are not tied to the location of the future channels. Afterwards, the channel system is produced by inflation, in hot deformation. The plates can be aluminium plates.

The housing can comprise a through hole for a fluid inlet connection of the fluid tank. The through hole can be arranged such that channels of the channels system have to pass around the through hole wherein a shift of the channels towards the upper housing side is kept as small as possible.

The housing bottom can comprise an alignment means for aligning the condenser in an angular direction. Thus, the condenser can easily be attached to the fluid tank in a correct orientation. The alignment means can be slot at the housing bottom.

The inlet opening can be arranged in an inlet portion of the housing that is separated by the remaining housing by at least one groove. Additionally, the outlet opening can be arranged in an outlet portion of the housing that is separated by the remaining housing by at least one other groove. The inlet portion and the outlet portion can be easily bent due to the provision of the grooves. This simplifies the connection of the inlet line to the inlet opening as the inlet portion can be bent to the position that is needed. The same applies to the connection of the outlet portion with the outlet line.

According to an advantageous embodiment a heat transfer system is provided. The heat transfer system comprises a fluid tank and at least one inventive condenser wherein the condenser is attached to the fluid tank. The condenser can be attached to a lower region of the fluid tank.

An insulating element can arranged between the housing part comprising at least a part of the outlet channel and the fluid tank. This is possible as the housing part can protrude from the remaining housing. By provision of the heat insulating element it is possible to reduce the heat amount from the fluid tank into the fluid flowing in the outlet channel.

A further condenser is provided wherein the condenser and the further condenser are connected with each other by a connection means. The housing part can lie on the connection means when the condensers are connected with each other.

According to an embodiment a heat pump is provided. The heat pump can comprise the heat transfer system, a pump for recirculating the fluid within a fluid circle of the heat pump, an evaporator and an expansion valve. The condenser, the pump, the evaporator and the expansion valve are fluidically connected with each other. The fluid stored in the fluid tank is not fluidically connected with the condenser, the pump, the evaporator and the expansion valve. The heat pump can be part of an air source heat pump or a ground source heat pump.

In the figures, the subject-matter of the invention is schematically shown, wherein identical or similarly acting elements are usually provided with the same reference signs.

Figure 2:
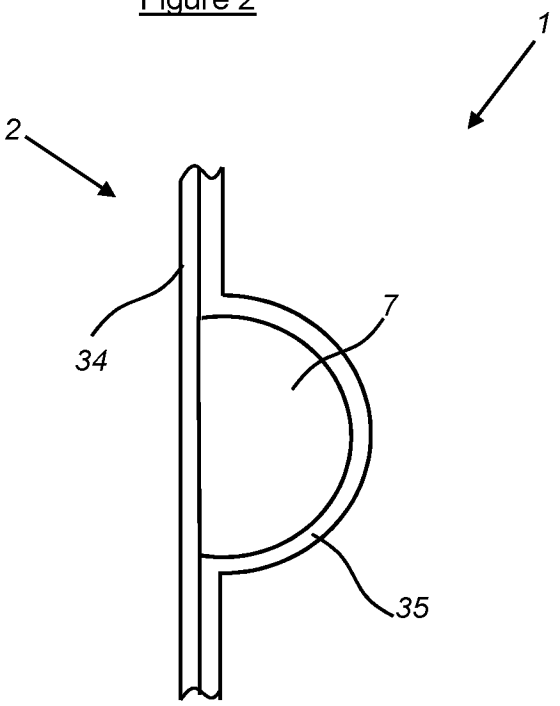
Figure 3:
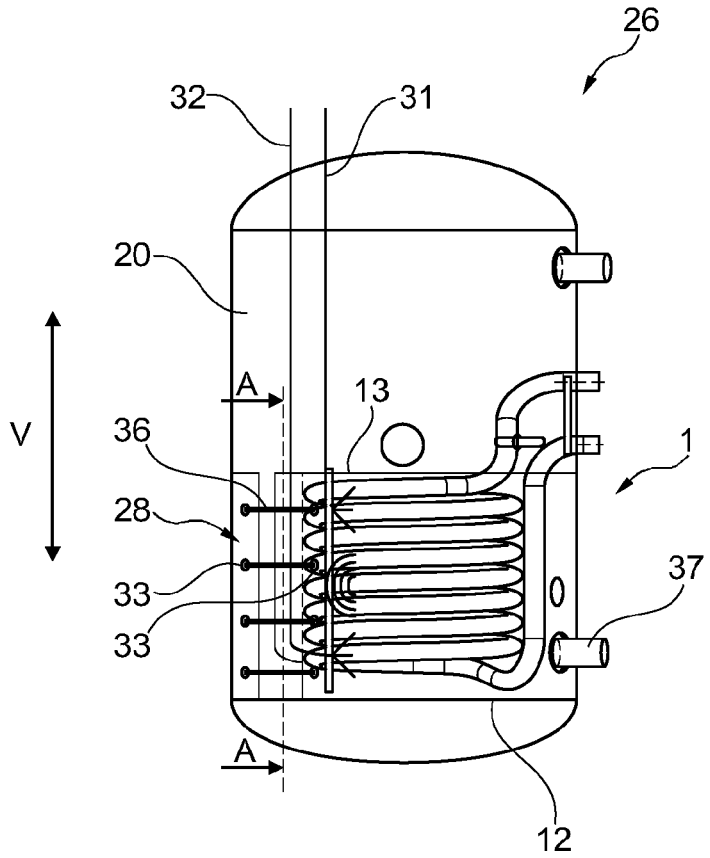
Figure 4:
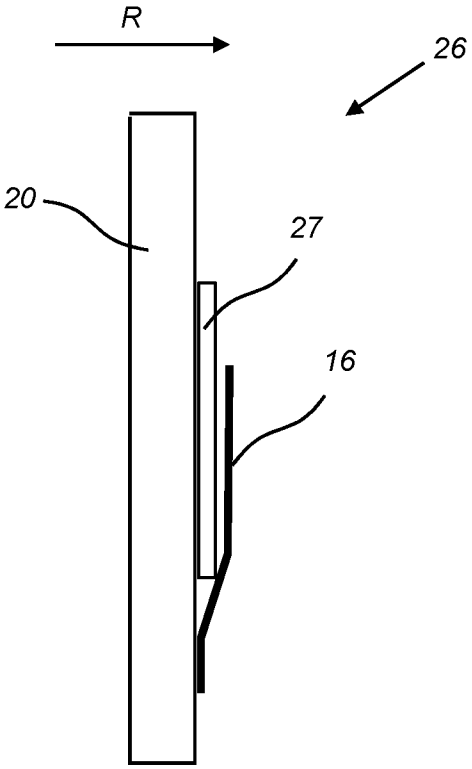
Figure 5:
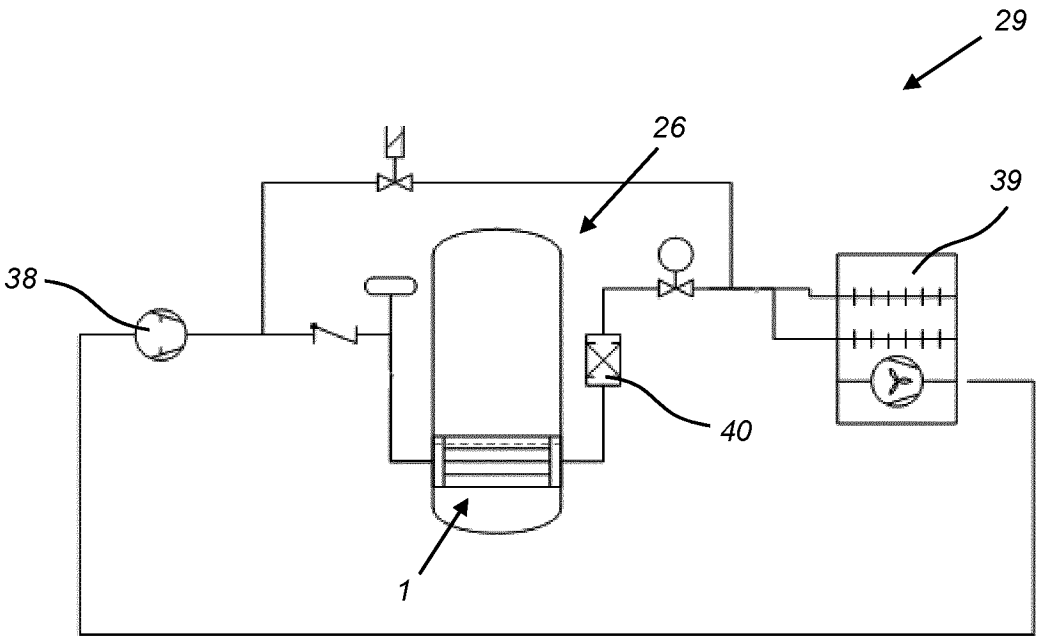
Figure 6:
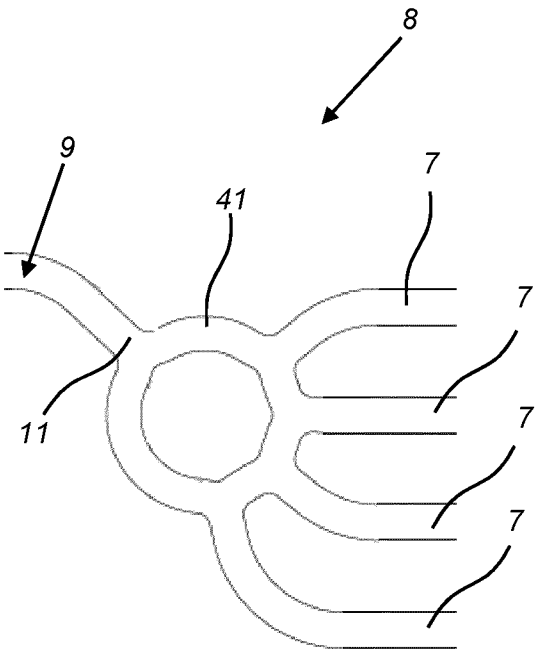
Figure 7:
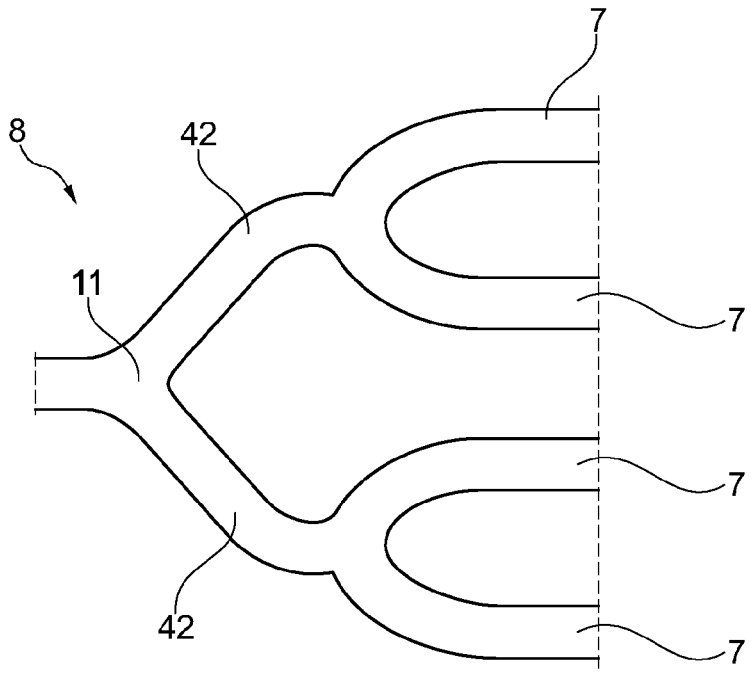

FIG. 1 shows a schematic view of an inventive condenser according to a first embodiment, FIG. 2 shows a cross section of a part of the condenser as shown in FIG. 1, FIG. 3 shows a heat transfer system comprising the condenser as shown in FIG. 1, FIG. 4 shows a cross section of a part of a heat transfer system shown in FIG. 3, FIG. 5 shows a schematic view of a heat pump with the condenser as shown in FIG. 1, FIG. 6 shows a grouping portion of a condenser according to a second embodiment, FIG. 7 shows a grouping portion of a condenser according to a third embodiment.

FIG. 1 shows a condenser 1 comprising a housing 2 and a channel system 5. The housing has an inlet opening 3 for inputting fluid into the condenser 1. The inputted fluid can be in a gas phase. Additionally, the housing 2 has an outlet opening 4 for outputting the fluid out of the condenser 1. The outputted fluid can be in a liquid phase.

The channel system 5 is used to fluidically connect the inlet opening 3 and the outlet opening 4 and is arranged within the housing 2. The channel system 5 comprises a splitting portion 6 in which the inputted fluid is split to a plurality of channels 7. In particular, an inlet channel 30 is provided that fluidically connects the inlet opening 3 with the splitting portion 6. Additionally, the channel system 5 comprises a grouping portion 8 in which the plurality of channels 7 is united to a single outlet channel 9. The grouping portion 8 is surrounded by the dotted rectangular shown in FIG. 1. A first end 10 of the outlet channel 9 ends in the outlet opening 4 and a second end 11 of the outlet channel 9 ends in the grouping portion 8.

The outlet channel 9 is formed such that a distance d1 between the second end 11 of the outlet channel 9 and a housing bottom 12 in a vertical direction V is between 0% to 80% of a distance d2 between the housing bottom 12 and an upper housing side 13 in the vertical direction V. The distances d1, d2 can be determined in a plane 14 comprising the second end 11 of the outlet channel 9 and a part of the housing bottom 12 and a part of the upper housing side 13. In particular, the distance d1 is about less than 50% of the distance d2, preferably less than 30% of the distance d2, in particular, less than 15% of the distance d2.

The inlet opening 3 is fluidically connected with an inlet line 31. The inlet line 31 is fixedly attached to the housing 2. The outlet opening 4 is fluidically connected with an outlet line 32. The outlet line 32 is fixedly attached to the housing 2.

The housing 2 comprises an inlet portion 22 comprising the inlet opening 3. The housing 2 comprises two grooves 23 separating the inlet portion 22 from other housing portions. The two grooves 23 enable that the inlet portion 22 can be easily bent. The housing 2 also comprises an outlet portion 24 comprising the outlet opening 4. Additionally, the housing 2 comprises two further grooves 25 separating the outlet portion 24 from other housing portions. The two further grooves 25 enable that the outlet portion 24 can be easily bent.

The channel system 5 comprises a constant number of channels 7 which extend between the splitting portion 6 and the grouping portion 8. The channels 7 extend in a meandering pattern, respectively. Meandering describes an irregularly or regularly curved and sinuous design of the channel.

The outlet channel 9 has a straight portion 15 which ends in the outlet opening 4. The straight portion 15 is longer than the remaining portion of the outlet channel 9. The remaining portion comprises the second end 11 of the outlet channel 9 that ends in the grouping portion 8. Fluid is united in the grouping portion 8 and flowing into the outlet channel 9 is redirected one time before it flows out the condenser by means of the outlet opening 4.

The housing 2 has a rectangular shape. The upper housing side 13 and the housing bottom 12 form the long sides of the rectangular housing. The inlet and outlet opening 3, 4 are arranged at the upper housing side. The housing 2 comprises a housing part 16 in which the straight portion 15 of the outlet channel 9 is arranged. The housing part 16 is cross-hatched in FIG. 1. At least a part of the housing part 16 is separated from a remaining housing part 17 by means of a slot 18.

The slot 18 extends from the upper housing side 13 towards the housing bottom 12 but ends before the housing bottom 12 is reached. The slot 18 enables that the housing part 16 can easily be bent so that the housing part 16 partly protrudes from the remaining housing part 17 when it is attached to the fluid tank 20 as is shown in FIG. 4.

The housing 2 comprises a plurality of attachment openings 33 by means of which the condenser 1 can be connected to the fluid tank 20 and/or connected with another condenser. The attachment openings 33 can be arranged along the lateral housing sides of the housing 2 that connect the upper housing side 13 with the housing bottom 12. The attachment openings 33 are located at a distance from each other.

An alignment means 21 is arranged at the housing bottom 12. The alignment means 21 is in form of a recess and is used to position the condenser in an angular correct position on the fluid tank 20. The housing 2 comprises a through hole 19 for receiving of a fluid inlet connection 37 as shown in FIG. 3.

FIG. 2 shows a cross section of a part of the condenser 1. In particular, FIG. 2 shows a cross section of the housing 2 comprising a channel 7. The housing comprises a first plate 34 that has a planer shape and a second plate 35 that is embossed. In particular, the second plate 35 is embossed such that the channel 7 is formed between the first plate 34 and the second plate 35. The second plate 35 is embossed such that the channel system 5 as described above is formed. The first and second plate 34, 35 are roll-bonded so that the housing 2 results as a final product of the roll-bonding process.

FIG. 3 shows a heat transfer system 26 comprising the condenser 1 as shown in FIG. 1. The heat transfer system 26 comprises in addition to the condenser 1 a fluid tank 20. The fluid tank 20 stores a fluid like water and is used to cool the fluid flowing in the condenser 1. In the embodiment shown in FIG. 3 a coil is arranged within the fluid tank 20. The condenser 1 can also be attached to a fluid tank 20 that does not have a coil.

The condenser 1 is in direct contact with the fluid tank 20 and arranged in a lower region, in particular the lowest region, of the fluid tank 20. Thereto, the housing 2 is flexible so that it can adapt to the fluid tank 20 shape.

The heat transfer system 26 comprises a further condenser 28 that is also in contact with the fluid tank 20. The two condensers 1, 28 are connected with each other by a plurality of connection means 36. Each of the connection means 36 is engaged with the attachment opening 33 of the respective condenser 1, 28.

The fluid tank 20 comprises a fluid inlet connection 37. The fluid inlet connection 37 extends through the through hole 19 of the housing 2. Fluid can be inputted to the fluid tank 20 by means of the fluid inlet connection 37.

FIG. 4 shows a cross section of a part of a heat transfer system 26 comprising the condenser 1 along the section A-A shown in FIG. 3. However, FIG. 4 does not show the connection means 36 used for connecting the two condensers 1, 28 with each other. FIG. 4 shows only a wall of the fluid tank 20 to which the condenser 1 attached.

As described above the housing part 16 is bent from the remaining housing part 17 shown in FIG. 1 along a radial direction R with respect to the fluid tank 20. In particular, the housing part 16 is bent such that a portion of the housing part 16 is offset located to the remaining housing part 17. This means, said portion of the housing part 16 is not in direct contact with fluid tank 20 the remaining housing part 17 of the housing but a space is formed between the fluid tank 20 and the portion of the housing part 16.

A heat insulation element 27 is arranged in said space and thus insulates the fluid tank from outlet channel 9, in particular the straight portion 15 of the outlet channel 9 arranged in the housing part 16.

FIG. 5 shows a schematic view of a heat pump 29 comprising the condenser 1. As discussed in FIG. 3 the condenser 1 is attached to the fluid tank 20. The heat pump 29 also comprises a pump 38 for recirculating the fluid in a fluid circuit of the heat pump 29, a evaporator 39 and an expansion valve 40. The condenser 1, pump 38, evaporator 39 and expansion valve 40 are fluidically connected with each other.

FIG. 6 shows a grouping portion 8 of a condenser according to another embodiment. The grouping portion 8 differs from the grouping portion shown in FIG. 1 in that it comprises a circle shaped channel 41. The channels 7 are directly connected with the circle shaped channel 41. Additionally, the outlet channel 9, in particular the second end 11 of the outlet channel, is directly connected with the circle shaped channel 41. Alternatively, the grouping portion 8 can be configured such that the channels 7 are directly connected with the second end 11 of the of the outlet channel 9. Such an embodiment is shown in FIG. 1.

The splitting portion 6 and the grouping portion 8 of the condenser 1 can have the same or similar basic shape.

FIG. 7 shows a grouping portion 8 of a condenser according to a third embodiment. The third embodiment differs from the second embodiment in the form of the grouping portion 8. The grouping portion 8 comprises two combining channels 42 that at one end are directly connected with two channels 7 and at the other end are directly connected with the second end 11 of the outlet channel 9.

REFERENCE SIGNS 1 condenser
2 housing
3 inlet opening

4 outlet opening
5 channel system
6 splitting portion
7 channel
8 grouping portion
9 outlet channel
10 first end of outlet channel
11 second end of outlet channel
12 housing bottom
13 upper housing side
14 plane
15 straight portion
16 housing part
17 remaining housing part
18 slot
19 through hole
20 fluid tank
21 alignment means
22 inlet portion
23 groove
24 outlet portion
25 other groove
26 heat transfer system
27 insulation element
28 further condenser
29 heat pump
30 inlet channel
31 inlet line
32 outlet line
33 attachment opening
34 first plate
35 second plate
36 connection means
37 fluid inlet connection
38 pump
39 evaporator
40 expansion valve
41 curved, in particular circle shaped, channel
42 combination channel
R radial direction
V vertical direction
d1 distance between the second end of the outlet channel and a housing bottom
d2 distance between the housing bottom and an upper housing side

The invention claimed is:

1. A condenser comprising:

a housing formed as a flexible monolithic structure through roll-bonding, the housing having an inlet opening for inputting fluid into the condenser and an outlet opening for outputting the fluid out of the condenser; and a channel system, defined by selectively inflated regions of the roll-bonded housing, for fluidically connecting the inlet opening and the outlet opening, wherein the channel system is arranged within the housing and comprises a splitting portion in which the inputted fluid is split to a plurality of channels, and a grouping portion in which the plurality of channels is united to an outlet channel;

wherein a first end of the outlet channel ends in the outlet opening and a second end of the outlet channel ends in the grouping portion; and wherein a distance between the second end of the outlet channel and a housing bottom in a vertical direction is between 0% to 80% of a distance between the housing bottom and an upper housing side in the vertical direction; and wherein the grouping portion of the channel system comprises a circle shaped channel defined within the housing, the circle shaped channel connected with the plurality of channels and the outlet channel.

2. The condenser according to claim 1, wherein;

the distance between the second end of the outlet channel and a housing bottom in the vertical direction is smaller than a distance between the second end of the outlet channel and the upper housing side in the vertical direction.

3. The condenser according to claim 1, wherein a length of the outlet channel is smaller than a length of one channel extending between the splitting portion and the grouping portion.

4. The condenser according to claim 1, wherein:

the outlet channel comprises a straight portion between its first end and second end wherein the straight portion is longer than a remaining part of the outlet channel.

5. The condenser according to claim 1, wherein the outlet opening and the inlet opening are arranged at the same upper housing side.

6. The condenser according to claim 1, wherein a housing part comprising at least a part of the outlet channel protrudes from a remaining housing part.

7. The condenser according to claim 6, wherein:

a. the housing comprises a slot dividing at least a part of the housing part from the remaining housing part; and/or b. at least a part of the housing part and the remaining housing part are arranged offset to each other.

8. The condenser according to claim 1, wherein the housing has a rectangular shape wherein a distance between two channels of the plurality of channels in direction along a short side of the housing is shorter than a distance between at least a part of the outlet channel and the channels of the plurality of channels in another direction along a length side of the housing.

9. The condenser according to claim 1, wherein:

at least one channel of the plurality of channels extending between the splitting portion and the grouping portion extends in a meandering pattern.

10. The condenser according to claim 1, wherein;

the housing bottom comprises an alignment means for aligning the condenser in an angular direction.

11. The condenser according to claim 1, wherein:

a. the inlet opening is arranged in an inlet portion of the housing that is separated from a remaining housing by at least one groove; and/or b. the outlet opening is arranged in an outlet portion of the housing that is separated from the remaining housing by at least one other groove.

12. A heat transfer system with a fluid tank and at least one condenser according to claim 1, wherein the condenser is attached to the fluid tank in direct contact with the fluid tank, and wherein the housing is flexibly adapted to a shape of the fluid tank.

13. The heat transfer system according to claim 12, wherein a further condenser is provided wherein the condenser and the further condenser are connected with each other.

14. A heat pump comprising a heat transfer system according to claim 12.

15. The heat transfer system according to claim 12, wherein an insulating element is arranged between a housing part and the fluid tank.

16. A heat pump comprising a condenser according to claim 1.

17. The condenser according to claim 1, wherein the channel system comprises a single grouping portion, and wherein a number of channels extending between the splitting portion and the grouping portion is constant.

18. The condenser according to claim 1, wherein the housing comprises a through hole for a fluid inlet connection of a fluid tank, and wherein at least a channel of the plurality of channels is arranged to pass around the through hole.

19. The condenser according to claim 1, wherein the distance between the second end of the outlet channel and the housing bottom is between 0% to 40% of the distance between the housing bottom and the upper housing side.

20. The condenser according to claim 1, wherein the outlet channel is adapted such that the fluid is not redirected between the second end of the outlet channel and the first end of the outlet channel or is redirected merely once between the second end of the outlet channel and the first end of the outlet channel.

* * * * *